US007266918B2

(12) United States Patent
Huenefeld

(10) Patent No.: US 7,266,918 B2
(45) Date of Patent: Sep. 11, 2007

(54) YARD SIGN WITH TRIMMED EDGES

(75) Inventor: Braden R. Huenefeld, West Chester, OH (US)

(73) Assignee: Dee Sign Co., West Chester, OH (US)

( * ) Notice: Subject to any disclaimer, the term of this patent is extended or adjusted under 35 U.S.C. 154(b) by 392 days.

(21) Appl. No.: 10/987,074

(22) Filed: Nov. 12, 2004

(65) Prior Publication Data

US 2006/0101689 A1 May 18, 2006

(51) Int. Cl.
*G09F 7/00* (2006.01)

(52) U.S. Cl. ..... 40/611.12; 40/781; 40/611.01; 40/603; 40/604

(58) Field of Classification Search ..... 40/611.12, 40/603, 781
See application file for complete search history.

(56) References Cited

U.S. PATENT DOCUMENTS

| | | | | |
|---|---|---|---|---|
| 451,282 | A | 4/1891 | St. John | |
| 1,182,303 | A | 5/1916 | Nichols | |
| 1,359,492 | A | 11/1920 | Demuth | |
| 1,497,945 | A | 6/1924 | Sayre | |
| 1,551,946 | A | 3/1925 | Flanagan | |
| D74,661 | S | 3/1928 | Browne et al. | |
| 1,667,091 | A | 4/1928 | Wolstenholme | |
| D78,577 | S | 5/1929 | Kerr | |
| 2,454,648 | A | 11/1948 | Green | |
| 2,596,064 | A | 5/1952 | Bishop et al. | |
| 2,872,750 | A | 2/1959 | Holcomb | |
| 3,138,886 | A * | 6/1964 | Cobb | 40/604 |
| 3,422,556 | A * | 1/1969 | Manning et al. | 40/651 |
| 4,040,194 | A * | 8/1977 | Penton et al. | 40/621 |
| 4,356,647 | A * | 11/1982 | Farris | 40/759 |
| 4,777,750 | A * | 10/1988 | Garfinkle | 40/607.04 |
| D303,814 | S | 10/1989 | Beck | |
| 4,885,860 | A | 12/1989 | Huenefeld | 40/606 |
| 4,916,840 | A | 4/1990 | Getz | 40/605 |
| 5,134,794 | A * | 8/1992 | Walrath | 40/781 |
| 5,148,618 | A | 9/1992 | Brewster | 40/626 |
| 5,215,585 | A * | 6/1993 | Luthra et al. | 106/806 |
| 5,675,923 | A * | 10/1997 | Sarkisian et al. | 40/612 |
| D399,261 | S | 10/1998 | Humphrey | |
| 5,911,523 | A * | 6/1999 | Burchart | 40/406 |
| 6,192,611 | B1 * | 2/2001 | Molla | 40/604 |
| D443,307 | S | 6/2001 | Nucci et al. | |
| 6,474,009 | B2 * | 11/2002 | Hahn | 40/658 |
| 2004/0200103 | A1 * | 10/2004 | Dombrowski | 40/603 |

* cited by examiner

*Primary Examiner*—Lesley D. Morris
*Assistant Examiner*—Marcus Menezes
(74) *Attorney, Agent, or Firm*—Wood, Herron & Evans, L.L.P.

(57) ABSTRACT

A yard sign includes a planar sign member and upper and lower trim members. The trim members are formed from complementary trim elements that are mirror images of each other and snap fit over the upper and lower edges of the sign. The trim members have openings in their distal surfaces which permit the sign to be supported by either a ground frame or hung from an overhead support.

6 Claims, 4 Drawing Sheets

YARD SIGN WITH TRIMMED EDGES

BACKGROUND OF THE INVENTION

Yard signs are used for a variety of different purposes. One particular use is to advertise the sale of homes. It is important that these signs have a pleasing and professional look. Further, this should be achieved without excessively increasing the cost of the sign or making it difficult to install.

SUMMARY OF THE INVENTION

The present invention is premised on the realization that a yard sign can be formed with a unique, professional eye-catching appeal without significantly increasing the cost and at the same time permitting the sign to be installed supported either by a ground frame from below or hung from a support.

More particularly, the present invention comprises upper and lower trim members that cover the upper and lower edges of the sign. The trim members are formed from basically mirror-image halves that when snapped together and have a channel that receives the edge of the sign. Complementary tabs and bosses in the trim elements extend through the sign as well as above and below the sign, and snap together to attach the trim member to the sign. Openings in the trim member allow the sign to be attached to a ground frame if the sign is to be supported directly from the ground, or to chains if the sign is going to be hung from a support.

The invention will be further appreciated in light of the following detailed descriptions and drawings in which:

DETAILED DESCRIPTION OF THE INVENTION

Figure 1:
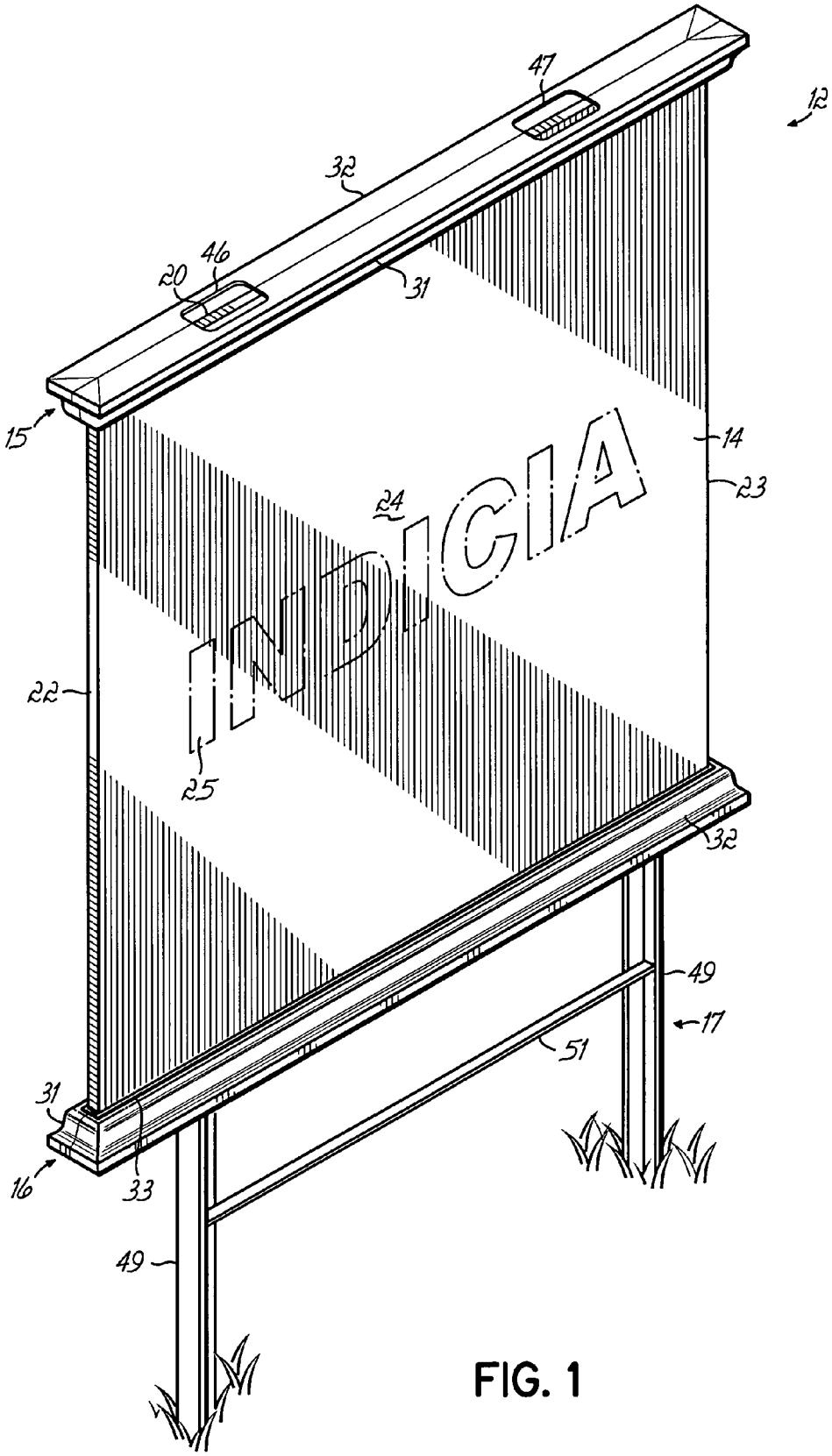
FIG. 1 is a perspective view of the present invention.
Figure 2:
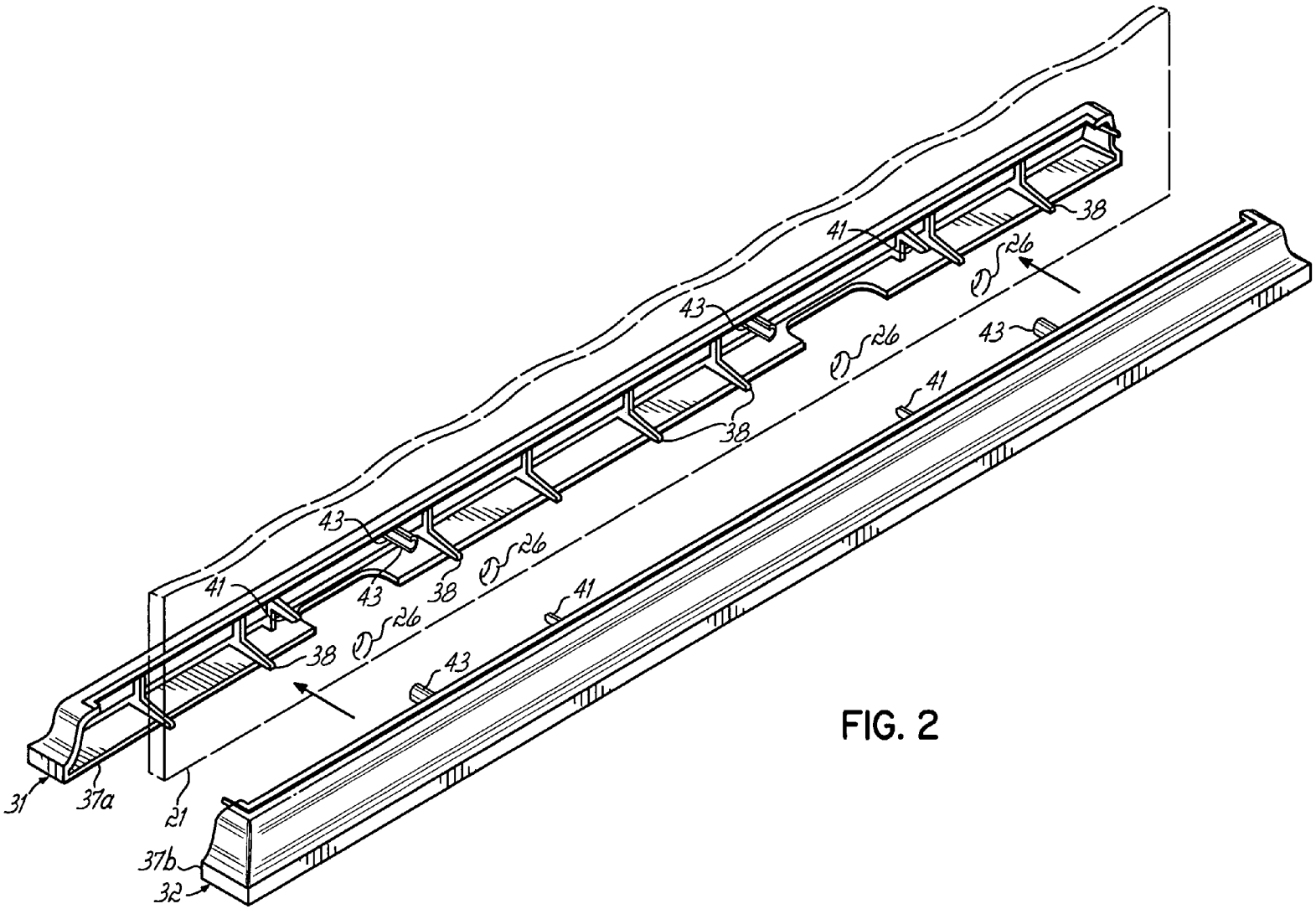
FIG. 2 is an exploded view of the trim element of the present invention, partially in phantom, partially broken away.
Figure 5:
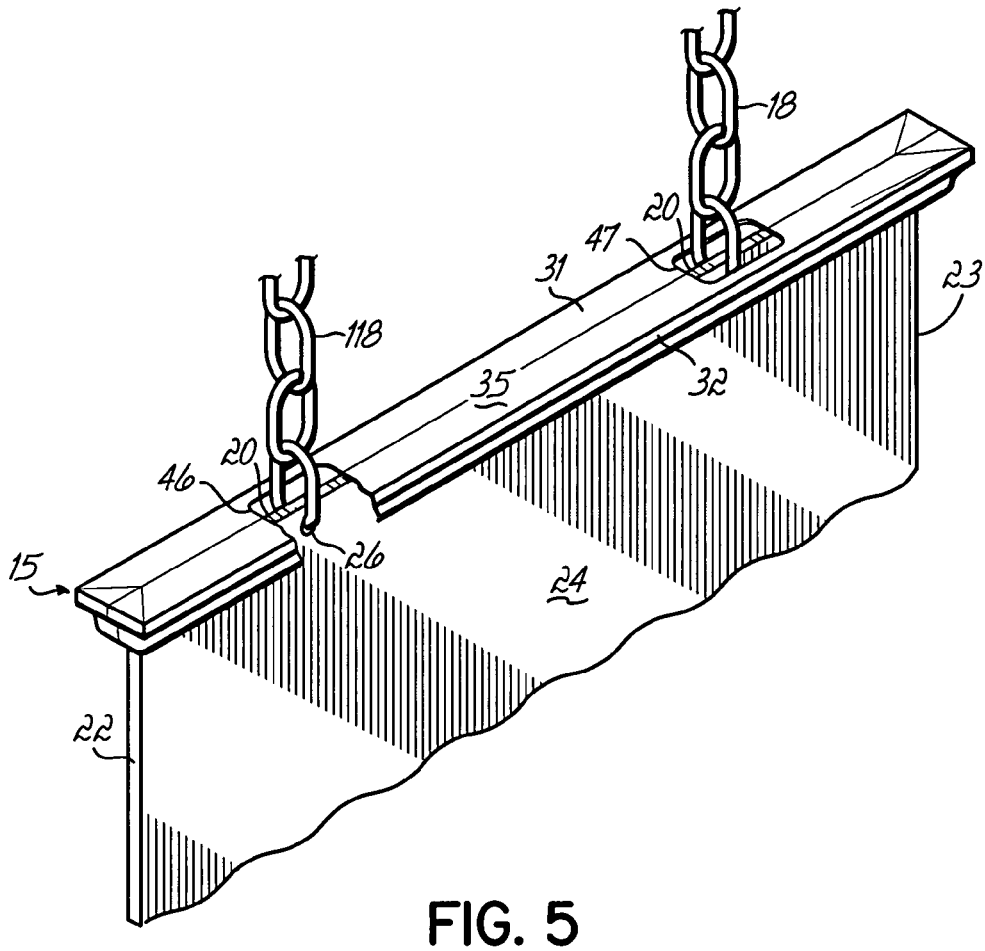
FIG. 5 is a perspective view partially broken away of the sign of the present invention hanging from chains.
Figure 6:
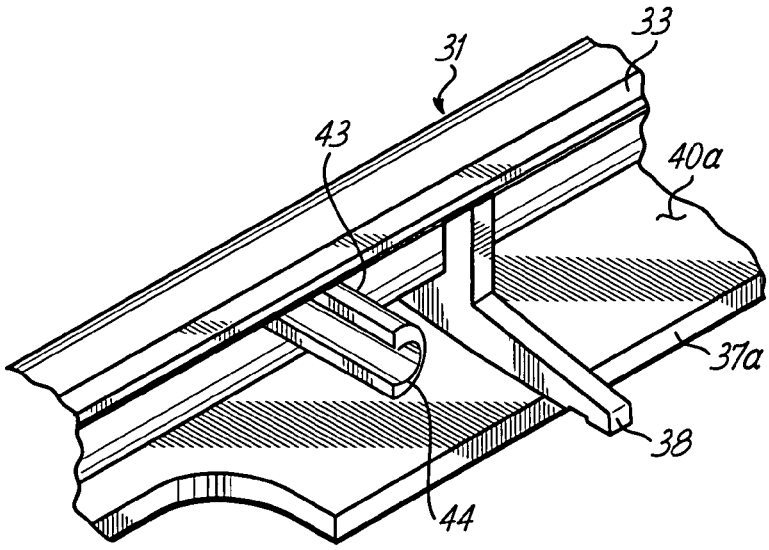
FIG. 6 is a perspective view partially broken away of a portion of the trim element of the present invention.

As shown in FIG. 1, the present invention is a yard sign 12 which includes a planar sign member 14. The sign 12 includes an upper trim member 15 and a lower trim member 16, as shown in FIG. 1, and is supported by a base frame 17. As shown in FIG. 5, the sign 12 can also can be hung from chains 18, hooks, or the like, if desired.

The planar sign member 14 includes an upper edge 20 and a lower edge 21, and side edges 22 and 23, respectively. These edges surround the field portion 24 of the planar sign 14 which includes the indicia 25. As shown, the planar sign member has a series of holes 26 near its upper and lower edges 20 and 21. This particular sign is formed from a corrugated plastic material that includes a plurality of parallel channels (not shown) that extend the length of the sign member 14.

The upper trim member 15 and lower trim member 16 are identical. The trim members 15 and 16 include a first trim element 31 and a second trim element 32. As shown, their exteriors are mirror images of each other. One portion of the trim members is a sign-engaging edge 33 which, when assembled, has a channel 34 that surrounds the lower edge 21 of planar sign 14.

Both trim elements 31 and 32 include prongs 38 on their lower interior surface that extend beyond edges 37*a* and 37*b* of the trim elements. These prongs are designed to engage corresponding ridges 39 in the lower interior surfaces 40*a* and 40*b* of trim elements 31 and 32.

Figure 3:
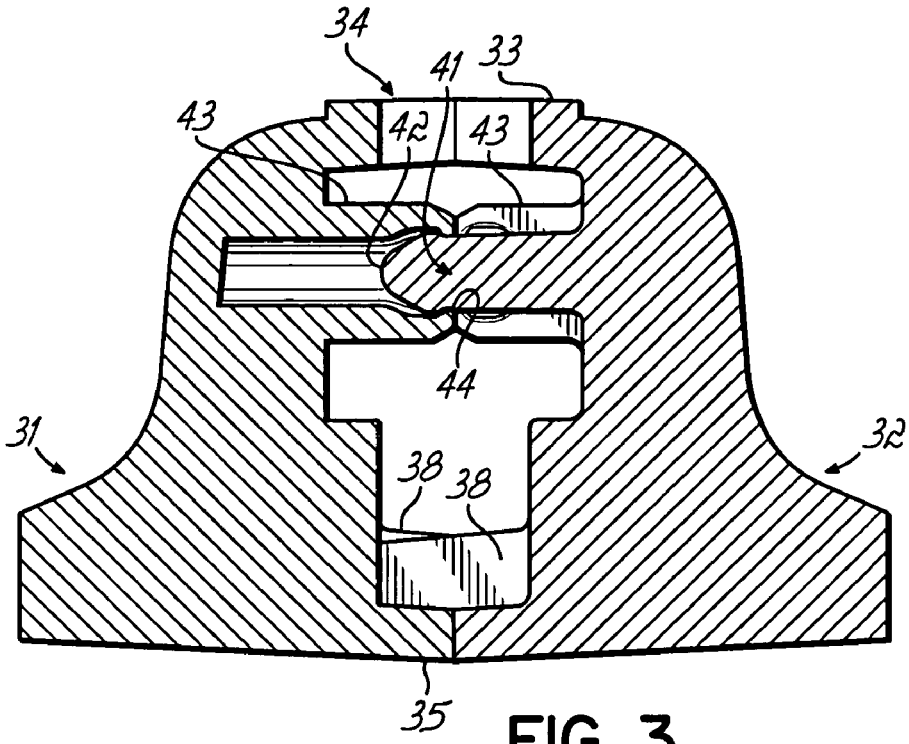
FIG. 3 is a cross sectional view of the trim element of the present invention.
Figure 4:
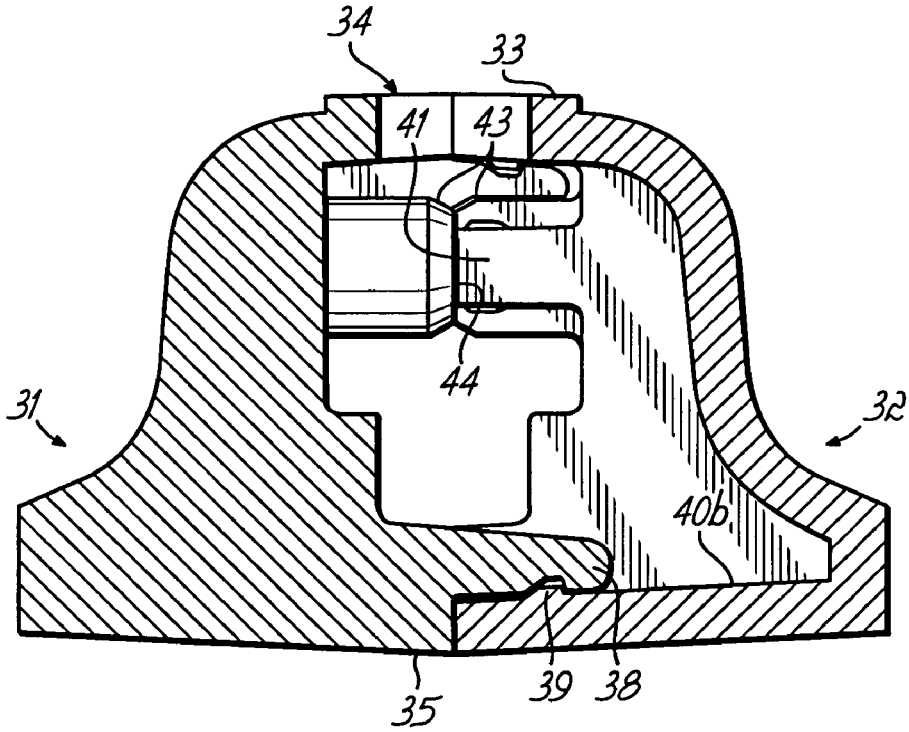
FIG. 4 is a second cross sectional view of the trim element of the present invention.

The trim elements 31 and 32 further include a plurality of tabs 41 which each include enlarged tip portion 42. The tabs 41 of element 31 are designed to engage semi-cylindrical bosses 43 on trim element 32, and the tabs 41 from trim element 32 likewise engage and lock into the semi-cylindrical bosses 43 in the trim element 31. This can best be seen in FIGS. 3 and 4. Because the semi-cylinders have a restricted or narrowed opening 44, the enlarged tips 42 of tabs 41 will engage these restricted openings 44, locking the first trim element to the second trim element. When attached together, the trim elements have first and second openings 46 and 47 in their distal surface 35. As will be described hereinafter, these provide an opening to allow the sign to be supported.

To assemble the sign 12 of the present invention, the first and second trim elements 31 and 32 are simply snap fitted over the upper and/or lower edges of the planar sign member 14. The semi-cylindrical bosses 43 and tabs 41 will extend through the holes 26 along the edges of the planar sign member. The tabs 41 will further engage the semi-cylinders holding the trim elements together. Likewise, the prongs 38 will engage the ridges 39 also, and hold the first and second trim elements 31 and 32 together. These prongs extend below the bottom edge of sign member 14.

These elements provide a cove molding around the upper and lower edges of the sign member. The trim elements can be modified to provide a different ornamental appearance such as distal molding, and the like.

As shown in FIG. 1, the sign 12 can be supported by a base support frame 17 which has legs 49 connected by cross member 51. Rods (not shown) extend up from the legs 49 and extend through the channels (not shown) in the planar sign member 14. This will hold the sign in position, supported directly from the ground. The rods extend through the openings 46 and 47 in the distal surface 35 which allows it to engage the channels (not shown) in the planar sign member, thereby supporting the sign.

The sign can also be hung from an overhead surface such as a cantilevered support. Hooks, chains or other elements can engage holes in the planar sign member 14 by extending through the openings 46 and 47 in the upper trim member 15. Thus, the trim elements do not interfere with displaying the sign.

The sign of the present invention provides a very neat professional appearance concealing the upper and lower edges of the sign and provides an eye-appealing trim element for the sign. This is done without significant expense. One does not have to mold the entire sign. Further, the trim elements of the present invention allow the sign to be supported either with a standard metal frame from the ground or to be hung from an overhead support. Thus, this significantly improves the overall appearance of the sign without significantly increasing the overall cost or requiring different support.

This has been a description of the present invention along with the preferred method of practicing the present invention. However, the invention itself should only be defined by the appended claims

I claim:

1. A yard sign comprising a planar sign member having upper and lower edges;

a trim member comprising first and second trim elements which snap fit together;

said trim member attached to said sign member and covering one of said upper and lower edges of said sign;

wherein said trim elements each have inter-engaging members which extend through said sign member;

said trim member having a distal surface said distal surface having at least one hole through which a support mechanism directly engage said sign member.

2. The yard sign claimed in claim 1 further comprising a second trim member wherein said first trim member covers said lower edge and said second trim member covers said upper ledge, and wherein at least one of said trim members includes a distal surface, said distal surface having a plurality of holes which enable a support mechanism to engage and support said sign member.

3. The yard sign claimed in claim 2 wherein a support engages holes in an upper edge of said sign member.

4. The yard sign claimed in claim 2 further comprising a support wherein said support is a ground frame adapted to engage and support said sign member from said bottom edge.

5. The yard sign claimed in claim 2 wherein said trim members each have complementary prongs and ridge elements which extend through holes in said sign member and engage each other and lock said trim member elements together.

6. The yard sign claimed in claim 1 wherein said inter-engaging members comprise tabs and semi-cylindrical bosses.

* * * * *